US011832750B2

(12) United States Patent
Guo

(10) Patent No.: US 11,832,750 B2
(45) Date of Patent: Dec. 5, 2023

(54) FOOD WASTE STORAGE DEVICE FOR DINING TABLE

(71) Applicant: Weinan Xingsheng Demolition Co.,Ltd., Weinan (CN)

(72) Inventor: Xiaowei Guo, Weinan (CN)

(73) Assignee: Weinan Xingsheng Demolition Co., Ltd., Weinan (CN)

( * ) Notice: Subject to any disclaimer, the term of this patent is extended or adjusted under 35 U.S.C. 154(b) by 751 days.

(21) Appl. No.: 16/940,369

(22) Filed: Jul. 27, 2020

(65) Prior Publication Data

US 2021/0038003 A1 Feb. 11, 2021

(30) Foreign Application Priority Data

Aug. 7, 2019 (CN) ..... 201910723396.5

(51) Int. Cl.

| | |
|---|---|
| ***A47G 29/14*** | (2006.01) |
| ***A47B 33/00*** | (2006.01) |
| ***A47G 29/093*** | (2006.01) |
| ***B65F 1/00*** | (2006.01) |
| ***B65F 1/14*** | (2006.01) |
| ***B65F 1/16*** | (2006.01) |
| ***A47B 13/08*** | (2006.01) |
| ***A47G 19/30*** | (2006.01) |

(52) U.S. Cl.

CPC ..... *A47G 29/14* (2013.01); *A47B 33/00* (2013.01); *A47G 29/093* (2013.01); *B65F 1/004* (2013.01); *B65F 1/0053* (2013.01); *B65F 1/1452* (2013.01); *B65F 1/1484* (2013.01); *B65F 1/1607* (2013.01); *A47B 13/08* (2013.01); *A47G 19/30* (2013.01)

(58) Field of Classification Search

CPC ..... A47B 13/08; A47B 13/16; A47B 37/00; A47B 33/00; A47G 29/14; A47G 29/093; A47G 19/30; B65F 1/004; B65F 1/0053; B65F 1/1484

See application file for complete search history.

(56) References Cited

U.S. PATENT DOCUMENTS

| | | | | | |
|---|---|---|---|---|---|
| 1,779,327 | A * | 10/1930 | Moss | A24F 19/02 | 108/26 |
| 5,572,934 | A * | 11/1996 | Aldridge | A47B 37/00 | D6/686 |
| 6,152,047 | A * | 11/2000 | Mac Namara | A47B 37/00 | 108/26 |
| 6,321,662 | B1 * | 11/2001 | Fraise | B65F 1/10 | 108/26 |

(Continued)

*Primary Examiner* — Daniel J Rohrhoff

(74) *Attorney, Agent, or Firm* — Slater Matsil, LLP

(57) ABSTRACT

The present invention discloses a food waste storage device for a dining table. A plurality of through holes are provided in the table top of the dining table; dish-shaped storage bucket fixing bases are provided on the lower end surfaces of the through holes; storage buckets are provided below the storage bucket fixing bases; a longitudinal partition plate is provided in each storage bucket to divide the storage bucket into two semicircular buckets; inner containers are provided in the two semicircular buckets; storage bucket upper covers are provided in the through holes; turnover covers capable of turning over symmetrically are provided on the storage bucket upper covers; and turnover shafts of the turnover covers are parallel to the partition plates.

7 Claims, 4 Drawing Sheets

(56) References Cited

U.S. PATENT DOCUMENTS

| | | | | |
|---|---|---|---|---|
| 6,802,263 | B1 * | 10/2004 | Kolb | A47B 37/00 108/26 |
| 8,347,790 | B1 * | 1/2013 | Maiers | A47B 25/00 108/26 |
| 2003/0131765 | A1 * | 7/2003 | Kaniuk | B65F 1/1468 108/25 |
| 2005/0204963 | A1 * | 9/2005 | Robinson | A47B 37/04 108/167 |
| 2007/0056482 | A1 * | 3/2007 | Robinson | A47B 37/04 108/25 |
| 2015/0068433 | A1 * | 3/2015 | Nardi | A47B 13/16 108/25 |

* cited by examiner

FOOD WASTE STORAGE DEVICE FOR DINING TABLE

CROSS-REFERENCE TO RELATED APPLICATION

This application claims priority to a patent filed in China on Aug. 7, 2019. Patent priority number 201910723396.5. The complete disclosure of the foregoing priority and related application is hereby fully incorporated by reference herein.

TECHNICAL FIELD

The present invention relates to a dining table, in particular to a food waste storage device for a dining table.

BACKGROUND

A dinner party of people is a common social activity. During the waiting time before the dinner party, people will eat sunflower seeds and smoke while talking with each other. People will place an ashtray on the table top to store waste such as sunflower seed shells or cigarette butts. Many ashtrays should be placed when there are many people so that it seems to be messy on the table. Some food waste such as bones and skins will also be generated during the dinner. These wastes are randomly stacked in front of people. In some small restaurants, the waste cannot be cleaned in time, which is very influencing the appetite of people. It is even unsightly if the waste is dropped on the ground, and it also increases the labor intensity of a waiter. With the development of human civilization, waste classification is gradually accepted by people. The problem that needs to be solved currently is how to classify the wastes at table, and directly put the classified wastes into classifying waste buckets after meals, and reduce the waste classifying procedures.

SUMMARY

In order to overcome the shortcomings in the prior art, the present invention provides a food waste storage device for a dining table.

The present invention is achieved by the following technical solution: a food waste storage device for a dining table, comprising a table top of a dining table, a plurality of through holes provided on the table top and a waste storage bucket below the through holes, wherein: dish-shaped storage bucket fixing bases are provided on the lower end surfaces of the through holes, a round hole as large as the through holes is provided in the center of the storage bucket fixing base, at least two "J" shaped necks are provided on the side wall of the storage bucket fixing base, storage buckets are provided below the storage bucket fixing bases, a fixing pin matching the neck is provided on the upper side wall of the storage bucket, the storage bucket is fixed on the storage bucket fixing base through the fixing pin, a longitudinal partition plate is provided in the storage bucket to divide the storage bucket into two semicircular buckets, freely accessible inner containers are provided in the two semicircular buckets, respectively, storage bucket upper covers are provided in the through holes, the storage bucket upper cover is provided with a flange to be laid on the upper end surfaces of the through holes, the flange is provided with a stopper extending into the through holes and exposing the lower end surfaces of the through holes, a positioning hole is provided on the side wall of the stopper, turnover covers capable of turning over symmetrically are provided in the stopper, turnover shafts of the turnover covers are parallel to the partition plates, a semicircular positioning plate is provided on the inner end surface of the storage bucket fixing base, and positioning pin shafts are provided at both ends of the positioning plate to be caught in the positioning hole.

In the above solution, a partition line parallel to the turnover shaft is provided on the upper end surface of the turnover cover, and the identifiers "kitchen waste" and "recyclable waste" are provided on both sides of the partition line.

In the above solution, the lower end surface of the turnover cover is provided with a groove, and the groove is a smoke extinguishing groove.

In the above solution, the storage bucket fixing base is fixed on the lower end surface of the table top by screws.

In the above solution, in order to facilitate fetching of the storage bucket, a handle is provided on the outer side wall of the storage bucket.

In the above solution, the identifiers corresponding to the identifiers "kitchen waste" and "recyclable waste" on the upper surface of the turnover cover are provided on the outer side wall surface of the storage bucket.

In the above solution, threads are provided on the outer side wall of the stopper of the storage bucket upper cover, and the storage bucket upper cover is locked in the storage bucket fixing base by a ring nut.

Compared with the prior art, the food waste storage device for a dining table of the present invention has the following beneficial effects.

1. In the food waste storage device for a dining table, during dining, the food waste on the table will be directly put in the storage bucket and will not affect the normal dinner, solving the problem that food waste is stacked on a dining table to influence the appetite. It will not affect the overall beauty of the dining table, and will reduce the workload for the waiter, which is convenient for tidying up the dining table.
2. The device is integrated with the table top and is provided under the table top so that the table top is tidy, environmentally friendly, hygienic, easy to clean, time-saving and labor-saving. The table top always looks neat and uncluttered.
3. The storage bucket is quickly connected to the waste inlet, which is convenient and fast to load and unload.
4. The device is provided with a waste classifying area, which is suitable for people to classify the wastes at table nowadays. The classified wastes are directly put into classifying waste buckets after meals, the waste classifying procedures are reduced, and civilization construction of human beings is promoted.
5. The device is provided with a smoke extinguishing groove on the turnover cover, which is convenient to use, without an additional ashtray.

In the figures: 1. a table top, 2. a through hole, 3. a storage bucket upper cover, 4. a storage bucket, 5. a turnover shaft, 6. a turnover cover, 7. a positioning plate, 8. a storage bucket fixing base, 9. a screw, 10. a fixing pin, 11. a partition plate, 12. a handle, 13. a neck, 14. an inner container, 15. a side wall identifier, 16. a positioning pin shaft, 17. a partition line, 18. a ring nut, 19. a groove.

DESCRIPTION OF THE EMBODIMENTS

Figure 1:
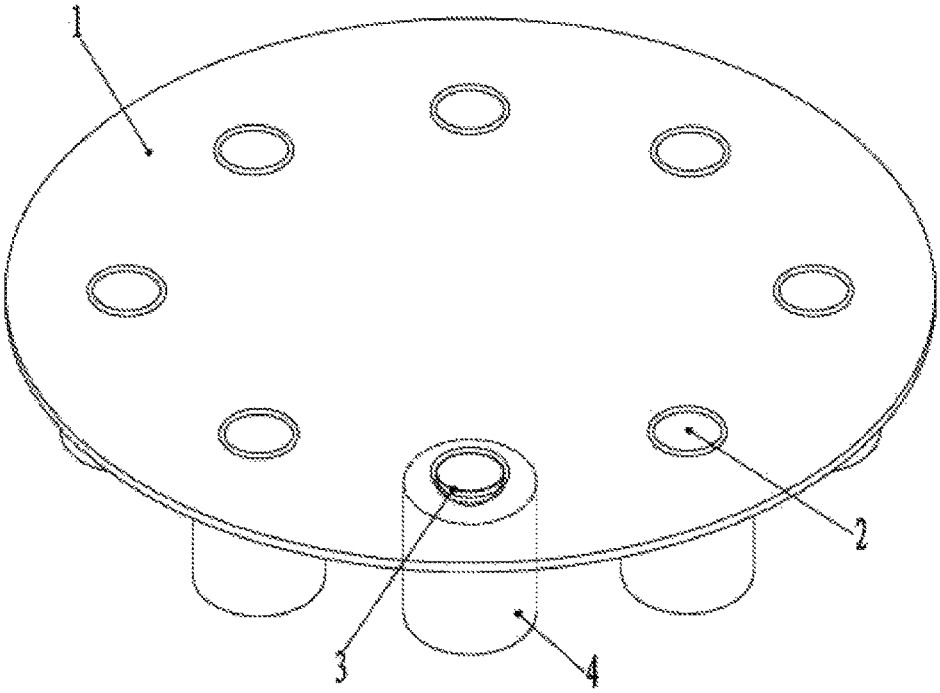
FIG. 1 is a schematic diagram of a structure of a food waste storage device for a dining table according to the present invention.
Figure 2:
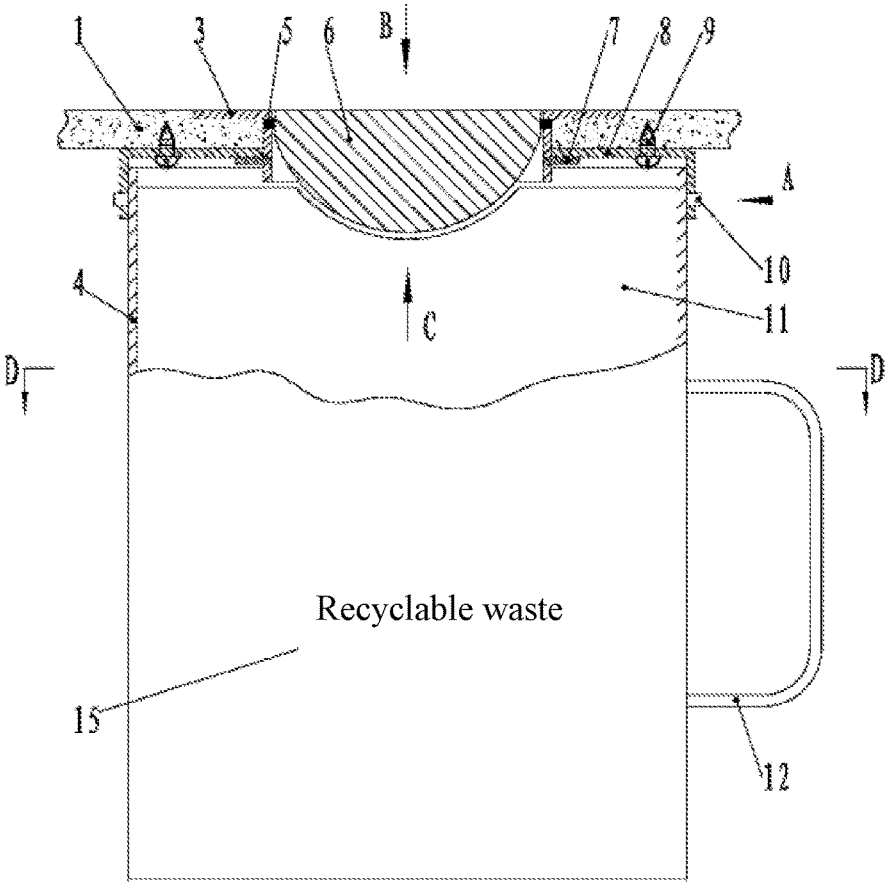
FIG. 2 is a cross-sectional diagram of a storage device.
Figure 3:
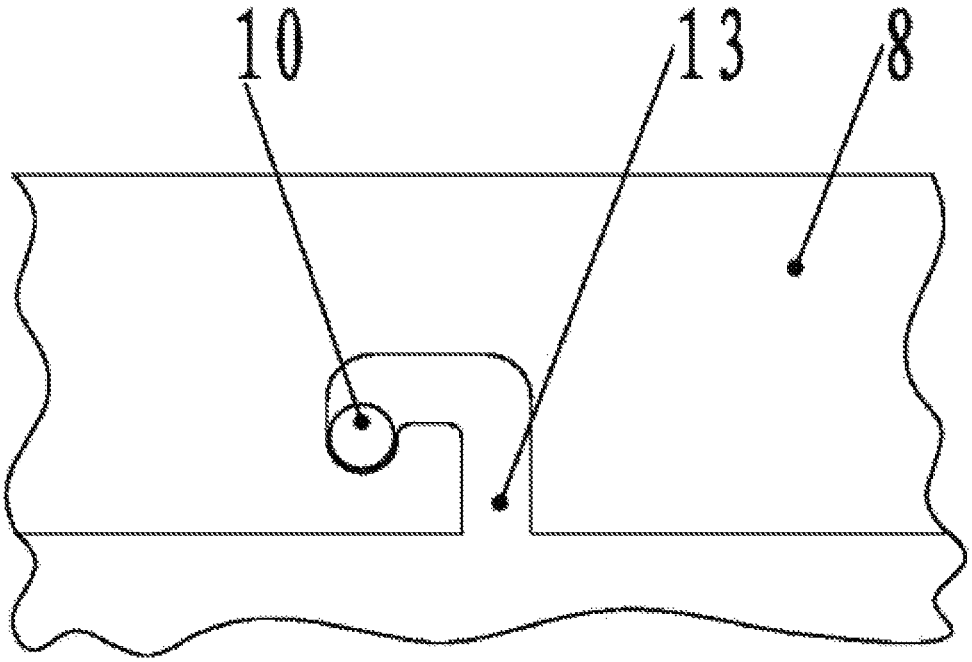
FIG. 3 is a diagram taken along the direction A in FIG. 2.
Figure 4:
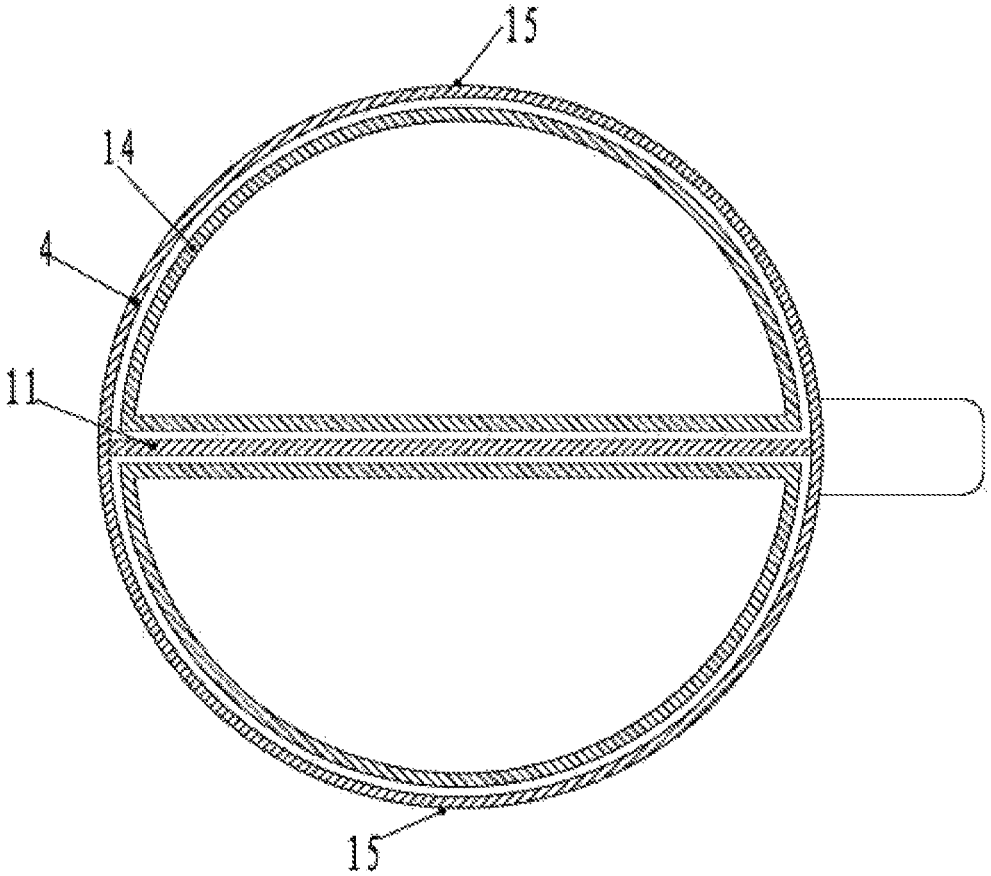
FIG. 4 is a cross-sectional diagram taken along D-D in FIG. 2.
Figure 5:
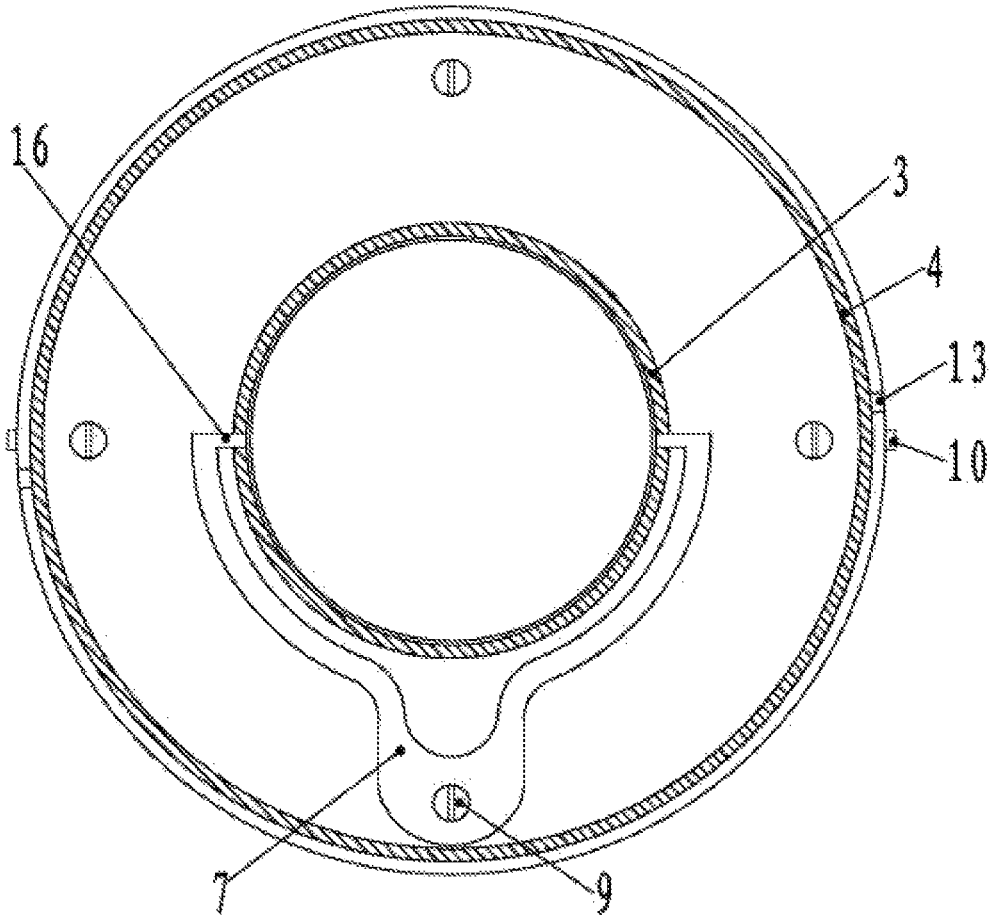
FIG. 5 is a diagram taken along the direction C in FIG. 2.
Figure 6:
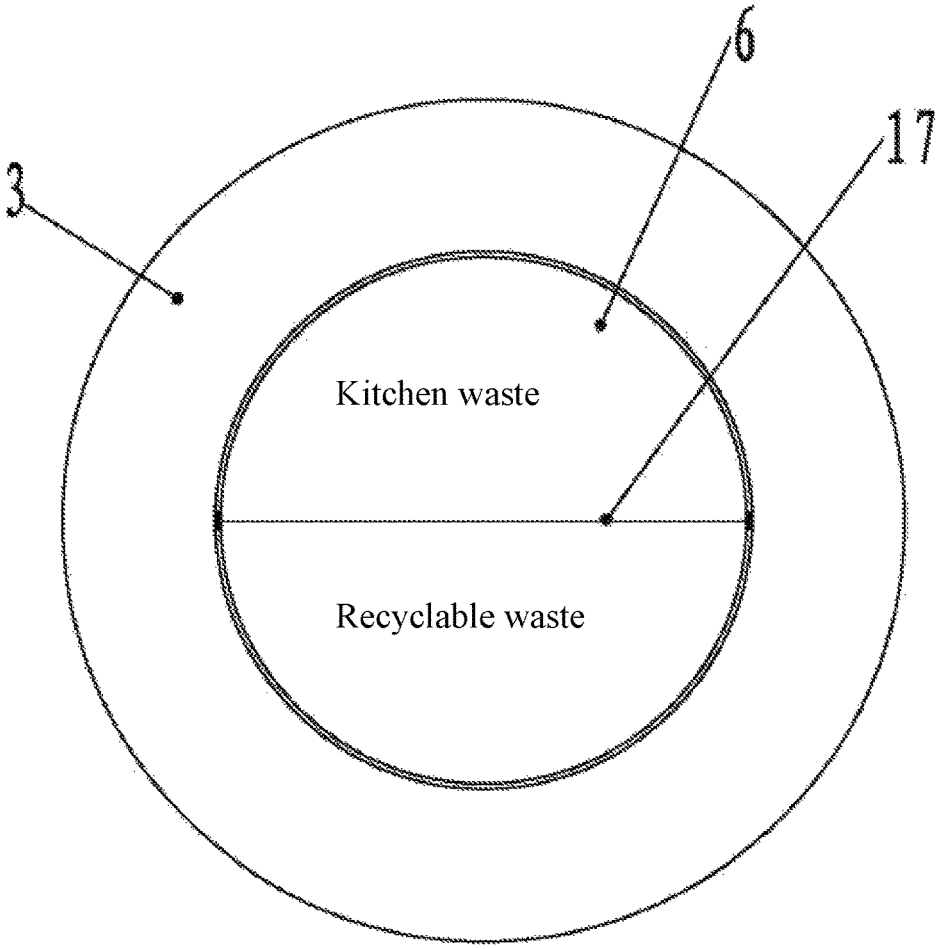
FIG. 6 is a diagram taken along the direction B in FIG. 2.

The food waste storage device for a dining table of the present invention will be further described below with reference to the drawings and specific embodiments:

FIG. 1 is a schematic diagram of a structure of a food waste storage device for a dining table according to the present invention. FIG. 2 is a cross-sectional diagram of a storage device. FIG. 3 is a diagram taken along the direction A in FIG. 2. FIG. 4 is a cross-sectional diagram taken along D-D in FIG. 2. FIG. 5 is a diagram taken along the direction C in FIG. 2. FIG. 6 is a diagram taken along the direction B in FIG. 2. In the figures, the food waste storage device for a dining table comprises a table top 1 of a dining table, a plurality of through holes 2 provided on the table top 1 and a waste storage bucket 4 below the through holes 1. Dish-shaped storage bucket fixing bases 8 are provided on the lower end surfaces of the through holes 2. A round hole as large as the through holes is provided in the center of the storage bucket fixing base 8. At least two "J" shaped necks 13 are provided on the side wall of the storage bucket fixing base. The storage bucket fixing bases 8 are fixed on the lower end surface of the table top by four screws 9. Storage buckets 4 are provided below the storage bucket fixing bases 8. Three fixing pins 10 matching the neck 13 are provided on the upper side wall of the storage bucket 4. During installation, the three fixing pins 10 are aligned with the neck 13 and are pushed upward and then rotated by an angle so that the fixing pin 10 is caught in the neck. A longitudinal partition plate 11 is provided in the storage bucket 4 to divide the storage bucket into two semicircular buckets. Freely accessible inner containers 14 are provided in the two semicircular buckets, respectively, so as to facilitate fetching of the storage bucket. A handle 12 is provided on the outer side wall of the storage bucket 4. Storage bucket upper covers 3 are provided in the through holes 2. The storage bucket upper cover 3 is provided with a flange to be laid on the upper end surfaces of the through holes 2. The flange is embedded in the table top and is flush with the table top. The flange is provided with a stopper extending into the through holes and exposing the lower end surfaces of the through holes. A positioning hole is provided on the side wall of the stopper. Turnover covers 6 capable of turning over symmetrically are provided in the stopper. Turnover shafts 5 of the turnover covers are parallel to the partition plates 11. A semicircular positioning plate 7 is provided on the inner end surface of the storage bucket fixing base 8. The positioning plate 7 is fixed by screws 9. Positioning pin shafts 16 are provided at both ends of the positioning plate 7 to be caught in the positioning hole on the side wall of the stopper. A partition line 17 parallel to the turnover shaft 5 is provided on the upper end surface of the turnover cover 6, and the identifiers "kitchen waste" and "recyclable waste" are provided on both sides of the partition line. The side wall identifiers 15 corresponding to the identifiers "kitchen waste" and "recyclable waste" on the upper surface of the turnover cover are provided on the outer side wall surface of the storage bucket 4. The side wall identifiers 15 are used to identify the waste classifying area of the two semicircular buckets of the storage bucket. The lower end surface of the turnover cover 6 is provided with a groove. After the turnover cover is turned over, the groove 19 faces upward, and the groove 19 can be used as a smoke extinguishing groove.

Figure 7:
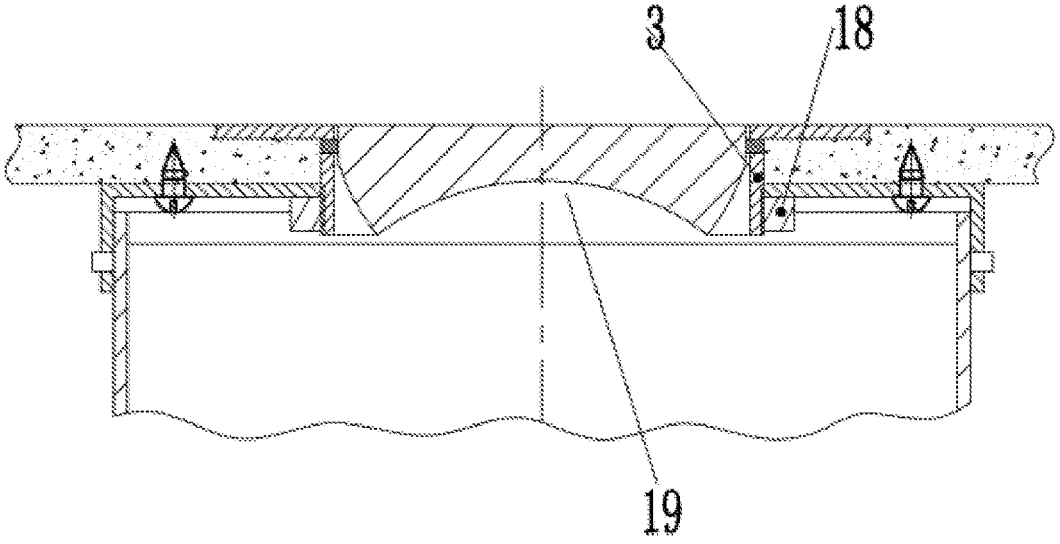
FIG. 7 is a cross-sectional diagram of another structure of a storage device.

FIG. 7 is a cross-sectional diagram of another structure of a storage device. Threads are provided on the outer side wall of the stopper of the storage bucket upper cover, and the storage bucket upper cover 3 is locked in the storage bucket fixing base by a ring nut 18. During locking, it is ensured that the turnover shaft 5 is parallel to the partition plate 11, and the identifier on the turnover cover 6 corresponds to the side wall identifier 15.

In the food waste storage device for a dining table, during dining, the food waste on the table will be directly put in the storage bucket and will not affect the normal dinner, solving the problem that food waste is stacked on a dining table to influence the appetite. The device is provided with a waste classifying area, which is suitable for people to classify the wastes at table nowadays. The classified wastes are directly put into classifying waste buckets after meals, the waste classifying procedures are reduced, and civilization construction of human beings is promoted. This product is not only suitable for dining tables, but also for furniture with table tops, such as coffee tables and desks.

The above are only the preferred embodiments of the present invention, rather than limit the present invention in any form. Although the present invention has been disclosed in the preferred embodiments as described above, it is not intended to limit the present invention. Those skilled in the art can use the methods and technical contents disclosed above to make slight changes or modifications to equivalent embodiments of equivalent changes without departing from the scope of the technical solutions of the present invention. However, any simple modifications, equivalent changes, and modifications to the above embodiments based on the technical essence of the present invention without departing from any content of the technical solutions of the present invention still fall within the scope of the technical solutions of the present invention.

What is claimed is:

1. A food waste storage device for a dining table, comprising a table top of a dining table, a plurality of through holes provided on the table top and a waste storage bucket below the through holes, wherein: dish-shaped storage bucket fixing bases are provided on lower end surfaces of the through holes, a round hole as large as each through hole of the through holes is provided in a center of a respective storage bucket fixing base of the storage bucket fixing bases, at least two "J" shaped necks are provided on a side wall of the respective storage bucket fixing base, a storage bucket is provided below the respective storage bucket fixing base, fixing pins matching the necks are provided on an upper side wall of the storage bucket, the storage bucket is fixed on the respective storage bucket fixing base through the fixing pins, a longitudinal partition plate is provided in the storage bucket to divide the storage bucket into two semicircular buckets, freely accessible inner containers are provided in the two semicircular buckets, respectively, a storage bucket upper cover is provided in the through hole, the storage bucket upper cover is provided with a flange to be laid on an upper end surface of the through hole, the flange is provided with a stopper extending into the through hole and exposing a lower end surface of the through hole, positioning holes are provided on a side wall of the stopper, a turnover cover capable of turning over symmetrically is provided in the stopper, a turnover shaft of the turnover cover is parallel to the longitudinal partition plate, a semicircular positioning plate is provided on an inner end surface of the respective storage bucket fixing base, and positioning pin shafts are provided at both ends of the positioning plate to be caught in the positioning holes.

2. The food waste storage device for a dining table according to claim 1, wherein a partition line parallel to the turnover shaft is provided on an upper end surface of the turnover cover, and identifiers "kitchen waste" and "recyclable waste" are respectively provided on both sides of the partition line.

3. The food waste storage device for a dining table according to claim 1, wherein a lower end surface of the turnover cover is provided with a groove, and the groove is a smoke extinguishing groove.

4. The food waste storage device for a dining table according to claim 1, wherein the respective storage bucket fixing base is fixed on a lower end surface of the table top by screws.

5. The food waste storage device for a dining table according to claim 1, wherein a handle is provided on an outer side wall of the storage bucket.

6. The food waste storage device for a dining table according to claim 2, wherein identifiers corresponding to the identifiers "kitchen waste" and "recyclable waste" on the upper end surface of the turnover cover are provided on an outer side wall surface of the storage bucket.

7. The food waste storage device for a dining table according to claim 1, wherein threads are provided on an outer side wall of the stopper of the storage bucket upper cover, and the storage bucket upper cover is locked in the respective storage bucket fixing base by a ring nut.

* * * * *